US006817421B2

(12) United States Patent
Dallas

(10) Patent No.: US 6,817,421 B2
(45) **Date of Patent: *Nov. 16, 2004**

(54) BLOWOUT PREVENTER PROTECTOR AND METHOD OF USING SAME

(76) Inventor: L. Murray Dallas, 790 River Oaks Dr., Fairview, TX (US) 75069

( * ) Notice: Subject to any disclaimer, the term of this patent is extended or adjusted under 35 U.S.C. 154(b) by 0 days.

This patent is subject to a terminal disclaimer.

(21) Appl. No.: 10/437,158

(22) Filed: May 13, 2003

(65) Prior Publication Data

US 2003/0192698 A1 Oct. 16, 2003

Related U.S. Application Data

(63) Continuation of application No. 09/537,629, filed on Mar. 29, 2000, now Pat. No. 6,626,245.

(51) Int. Cl.[7] ..... E21B 33/068

(52) U.S. Cl. ..... 166/379; 166/72; 166/85.4; 166/90.1

(58) Field of Search ..... 166/379, 72, 85.4, 166/90.1, 77.2, 77.4, 378, 381, 383

(56) References Cited

U.S. PATENT DOCUMENTS

| | | | | |
|---|---|---|---|---|
| 3,830,304 A | 8/1974 | Cummins | 166/305 R |
| 4,241,786 A | 12/1980 | Bullen | 166/77 |
| 4,632,183 A | 12/1986 | McLeod | 166/77 |
| 4,832,128 A | 5/1989 | Light et al. | 166/377 |
| 4,867,243 A | 9/1989 | Garner et al. | 166/379 |
| 4,993,488 A | 2/1991 | McLeod | 166/72 |
| 5,012,865 A | 5/1991 | McLeod | 166/90 |
| 5,515,925 A | 5/1996 | Boychuk | 166/379 |
| 5,785,121 A | 7/1998 | Dallas | 166/90.1 |
| 5,819,851 A | 10/1998 | Dallas | 166/308 |
| 5,927,403 A | 7/1999 | Dallas | 166/77.51 |
| 6,220,363 B1 | 4/2001 | Dallas | 166/382 |
| 6,247,537 B1 | 6/2001 | Dallas | 166/379 |
| 6,289,993 B1 | 9/2001 | Dallas | 166/386 |
| 6,364,024 B1 | 4/2002 | Dallas | 166/379 |
| 6,626,245 B1 * | 9/2003 | Dallas | 166/379 |

* cited by examiner

*Primary Examiner*—David Bagnell
*Assistant Examiner*—Giovanna Collins
(74) *Attorney, Agent, or Firm*—Nelson Mullins Riley & Scarborough, LLP

(57) ABSTRACT

A blowout preventer (BOP) protector is adapted to support a tubing string in a wellbore so that the tubing string is directly accessible during a well treatment to stimulate production. The BOP protector includes a mandrel having a sealing assembly mounted to its bottom end for pack-off in a casing of a well to be stimulated. The mandrel is connected at its top end to a fracturing head, including a central passage and radial passages in fluid communication with the central passage. The mandrel is locked in a fixed position by a lockdown nut that prevents upward movement induced by fluid pressures in the wellbore. The advantages are that the BOP protector permits access to the tubing string during well treatment and enables an operator to move the tubing string up and down or run coil tubing into or out of the wellbore without removing the tool. This reduces operation costs, saves time and enables many new procedures that were previously impossible or impractical.

23 Claims, 7 Drawing Sheets

BLOWOUT PREVENTER PROTECTOR AND METHOD OF USING SAME

This is a continuation of U.S. patent application Ser. No. 09/537,629 filed Mar. 29, 2000 now U.S. Pat. No. 6,626,245, the entire disclosure of which is incorporated by reference herein.

TECHNICAL FIELD

The present invention relates to equipment for servicing oil and gas wells and, in particular, to an apparatus and method for protecting blowout preventers from exposure to high pressure and abrasive or corrosive fluids during well fracturing and stimulation procedures while providing direct access to production tubing in the well and permitting production tubing to be run in or out of the well.

BACKGROUND OF THE INVENTION

Most oil and gas wells eventually require some form of stimulation to enhance hydrocarbon flow to make or keep them economically viable. The servicing of oil and gas wells to stimulate production requires the pumping of fluids under high pressure. The fluids are generally corrosive and abrasive because they are frequently laden with corrosive acids and abrasive proppants such as sharp sand.

The components which make up the wellhead such as the valves, tubing hanger, casing hanger, casing head and the blowout preventer equipment are generally selected for the characteristics of the well and not capable of withstanding the fluid pressures required for well fracturing and stimulation procedures. Wellhead components are available that are able to withstand high pressures but it is not economical to equip every well with them.

There are many wellhead isolation tools used in the field that conduct corrosive and abrasive high pressure fluids and gases through the wellhead components to prevent damage thereto.

The wellhead isolation tools in the prior art generally insert a mandrel through the various valves and spools of the wellhead to isolate those components from the elevated pressures and the corrosive and abrasive fluids used in the well treatment to stimulate production. A top end of the mandrel is connected to one or more high pressure valves, through which the stimulation fluids are pumped. In some applications, a pack-off assembly is provided at a bottom end of the mandrel for achieving a fluid seal against an inside of the production tubing or casing so that the wellhead is completely isolated from the stimulation fluids. One such tool is described in Applicant's U.S. Pat. No. 4,867,243, which issued Sep. 19, 1989 and is entitled WELLHEAD ISOLATION TOOL AND SETTING TOOL AND METHOD OF USING SAME.

In an improved wellhead isolation tool configuration, the mandrel in an operative position, requires fixed-point pack-off in the well, as described in Applicant's U.S. Pat. No. 5,819,851, which issued Oct. 13, 1998 and is entitled BLOWOUT PREVENTER PROTECTOR FOR USE DURING HIGH-PRESSURE OIL/GAS WELL STIMULATION. A further improvement of that tool is described in Applicant's co-pending U.S. patent application Ser. No. 09/299,551 which was filed on Apr. 26, 1999 and is entitled HIGH PRESSURE FLUID SEAL FOR SEALING AGAINST A BIT GUIDE IN A WELLHEAD AND METHOD OF USING SAME. The mandrel described in this patent and patent application includes an annular sealing body attached to the bottom end of the mandrel for sealing against a bit guide which is mounted on the top of a casing in the wellhead.

This type of isolation tool advantageously provides full access to a well casing and permits use of downhole tools during a well stimulation treatment. A mechanical lockdown mechanism for securing a mandrel requiring fixed-point pack-off in the well is described in Applicant's U.S. patent application Ser. No. 09/338,752 which was filed on Jun. 23, 1999 and is entitled BLOWOUT PREVENTER PROTECTOR AND SETTING TOOL. The mechanical lockdown mechanism has an axial adjusting length adequate to compensate for variations in a distance between a top of the blowout preventer and the top of the casing of the different wellheads to permit the mandrel to be secured in the operative position even if a length of a mandrel is not precisely matched with a particular wellhead. The mechanical lockdown mechanism secures the mandrel against the bit guide to maintain a fluid seal but does not restrain the mandrel from downwards movement. The force exerted on the annular sealing body between the bottom end of the mandrel and the bit guide results from a combination of the weight of the isolation tool and attached valves and fittings, a force applied by the lockdown mechanism and an upward force exerted by fluid pressures acting on the mandrel.

The wellhead isolation tools described in the above patents and patent applications work well and are in significant demand. However, it is also desirable from a cost and safety standpoint, to be able to leave the tubing string, or as it is sometimes called the "kill string", in the well during a well stimulation treatment. The above-described wellhead isolation tool is not adapted to support a tubing string left in the well because the weight of a long tubing string may damage the seal between the bottom of the mandrel and the bit guide.

Some prior art wellhead isolation tools are adapted for well stimulation treatment with a tubing string left in the well. For example, Canadian Patent No. 1,281,280 which is entitled ANNULAR AND CONCENTRIC FLOW WELLHEAD ISOLATION TOOL AND METHOD OF USE THEREOF, which issued to McLeod on Mar. 12, 1991, describes an apparatus for isolating the wellhead equipment from the high pressure fluids pumped down to the production formation during the procedures of fracturing and acidizing oil and gas wells. The apparatus utilizes a central mandrel inside an outer mandrel and an expandable sealing nipple to seal the outer mandrel against the casing. The bottom end of the central mandrel is connected to a top of the tubing string and a sealing nipple is provided with passageways to permit fluids to be pumped down the tubing and/or the annulus between the tubing and the casing in an oil or gas well. One disadvantage of this apparatus is that the fluid flow rate is restricted by the diameter of the outer mandrel which must be smaller than the diameter of the casing of the well and further restricted by the passageways in the sealing nipple between the central and outer mandrels. The sealing nipple also blocks the annulus, preventing tools from being run down the wellbore. The passageways in the sealing nipple are also susceptible to damage by the abrasive particle-laden fluids and are easily washed-out during a well stimulation treatment. A further disadvantage of the isolation tool is that the tool has to be removed and re-installed every time the tubing string is to be moved up or down in the well.

Applicant's co-pending United States Patent application entitled BLOWOUT PREVENTER PROTECTOR AND METHOD OF USING SAME which was filed on Jan. 28, 2000 and has been assigned Ser. No. 09/493,802, describes an improved isolation tool which is adapted for use with a tubing string to be left in the well, or run into or out of the well during a well stimulation treatment. The blowout preventer protector seals against a bit guide of the well and provides full access to the casing of the well to permit downhole tools to be run in or out of the casing. However, there are certain types of wellheads which do not include a bit guide. Such wellheads are generally referred to as "Larkin-type" wellheads. In Larkin-type wellheads, the top of the casing is threaded and the wellhead is screwed to the top of the wellhead using a high-pressure sealing compound, or the like. Consequently, the blowout preventer protector described in Applicant's co-pending patent application filed Jan. 28, 2000 cannot be used to service such wells. In addition, as wells age and are stressed by extended use, the seal between the bit guide and the casing cannot always be relied on to withstand elevated fluid pressures.

There therefore exists a need for a blowout preventer protector that seals off in the casing of the well while providing access to tubing in the well or permitting tubing to be run into or out of the well.

SUMMARY OF THE INVENTION

It is an object of the invention to provide a BOP protector which is adapted to support a tubing string in a wellbore so that the tubing string is accessible during a well treatment to stimulate production.

It is a further object of the invention to provide a BOP protector that permits a tubing string to be moved up and down in the wellbore without removing the BOP protector from the wellhead.

It is another object of the present invention to provide a BOP protector that permits a tubing string to be run into or out of the wellbore without removing the BOP protector from the wellhead.

In accordance with one aspect of the invention, there is provided an apparatus for protecting a blowout preventer from exposure to fluid pressures, abrasives and corrosive fluids used in a well treatment to stimulate production. The apparatus is adapted to support a tubing string in a wellbore so that the tubing string is accessible during the well treatment. The apparatus includes a mandrel adapted to be inserted down through the blowout preventer to an operative position. The mandrel has a mandrel top end and a mandrel bottom end. The mandrel bottom end includes a sealing assembly for sealing engagement with a casing of the well when the mandrel is in the operative position. A base member is adapted for connection to the wellhead and includes fluid seals through which the mandrel is reciprocally moveable. The apparatus further comprises a fracturing head, a tubing adapter and a lock mechanism. The fracturing head includes a central passage in fluid communication with the mandrel and at least one radial passage in fluid communication with the central passage. The tubing adapter is mounted to a top end of the fracturing head and supports the tubing string while permitting fluid communication with the tubing string. The lock mechanism for locking the apparatus in the operative position to inhibit upward movement of the mandrel induced by fluid pressures in the wellbore.

The apparatus preferably includes a mandrel head affixed to the mandrel top end and the fracturing head is mounted to the mandrel head. The lock mechanism preferably includes a mechanical lockdown mechanism which is adapted to inhibit upward movement of the mandrel head induced by fluid pressures when the mandrel is in the operative position.

More especially, according to an embodiment of the invention, the base member has a central passage to permit the insertion and removal of the mandrel. The passage is surrounded by an integral sleeve having an elongated spiral thread for engaging a lockdown nut that is adapted to secure the mandrel in the operative position. A passage from the mandrel head top end to the mandrel head bottom end is provided for fluid communication with the mandrel and permits the tubing string to extend therethrough.

The tubing adapter is configured to meet the requirements of a job. It may be a flange for mounting a BOP to the top of the apparatus so that tubing can be run into or out of the well. Alternatively, the tubing adapter may include a threaded connector to permit the connection of a tubing string that is already in the well.

A blast joint may be connected to the tubing adapter if coil tubing is run into the well. The blast joint protects the coil tubing from erosion when abrasive fluids are pumped through the fracturing head.

In accordance with another aspect of the invention, a method is described for providing access to a tubing string while protecting a blowout preventer on a wellhead from exposure to fluid pressure as well as to abrasive and corrosive fluids during a well treatment to stimulate production. The method comprises:

a) suspending the apparatus above the wellhead;

b) aligning the apparatus with a tubing string supported on the wellhead and lowering the apparatus until a top end of the tubing string extends through the axial passage above the fracturing head;

c) connecting the top end of the tubing string to a top end of the fracturing head, lowering the tubing string and the apparatus until the apparatus rests on the wellhead, and mounting the base member to the wellhead;

d) opening the blowout preventer;

e) lowering the tubing string and the fracturing head to stroke the mandrel bottom end down through the wellhead into the casing of the well until the mandrel reaches an operative position in which the fracturing head rests on the base member and the seal assembly is in sealing contact with an inner wall of the casing; and f) locking the fracturing head to the base member to inhibit the mandrel from upward movement induced by fluid pressure in the well.

In accordance with a further aspect of the invention, a method is described for running a tubing string into or out of a well while protecting a first blowout preventer on a wellhead of the well from exposure to fluid pressure as well as to abrasive and corrosive fluids during a well treatment to stimulate production. The method related to the use of the above-described apparatus comprises:

a) mounting the base member of the apparatus to the wellhead;

b) closing at least one second blowout preventer which is mounted to an adapter flange mounted to a top the fracturing head;

c) opening the first blowout preventer;

d) lowering the fracturing head to stroke the mandrel bottom end down through the wellhead into the casing until the mandrel is in an operative position in which the fracturing head rests against the base member and the annular sealing assembly is in fluid sealing engagement with an inner wall of the casing of the well;

e) locking the mandrel in the operative position to prevent the mandrel from upward movement induced by fluid pressure in the well; and f) running the tubing string into or out of the well through the at least one second blowout preventer.

A primary advantage of the invention is the capability to support a tubing string in a wellbore during the well stimulation treatment. This provides direct access to both the tubing string and the well casing so that the use of the apparatus is extended to a wide range of well service applications.

Furthermore, the apparatus permits the tubing string to be moved up and down, or run in or out of the well without removing the apparatus from the wellhead. The tubing string can even be moved up or down in the well while well treatment fluids are being pumped into the well. Labour and the associated costs are thus reduced.

BRIEF DESCRIPTION OF THE DRAWINGS

The invention will now be further described by way of illustration only and with reference to the accompanying drawings, in which.

DETAILED DESCRIPTION OF THE PREFERRED EMBODIMENT

Figure 1:
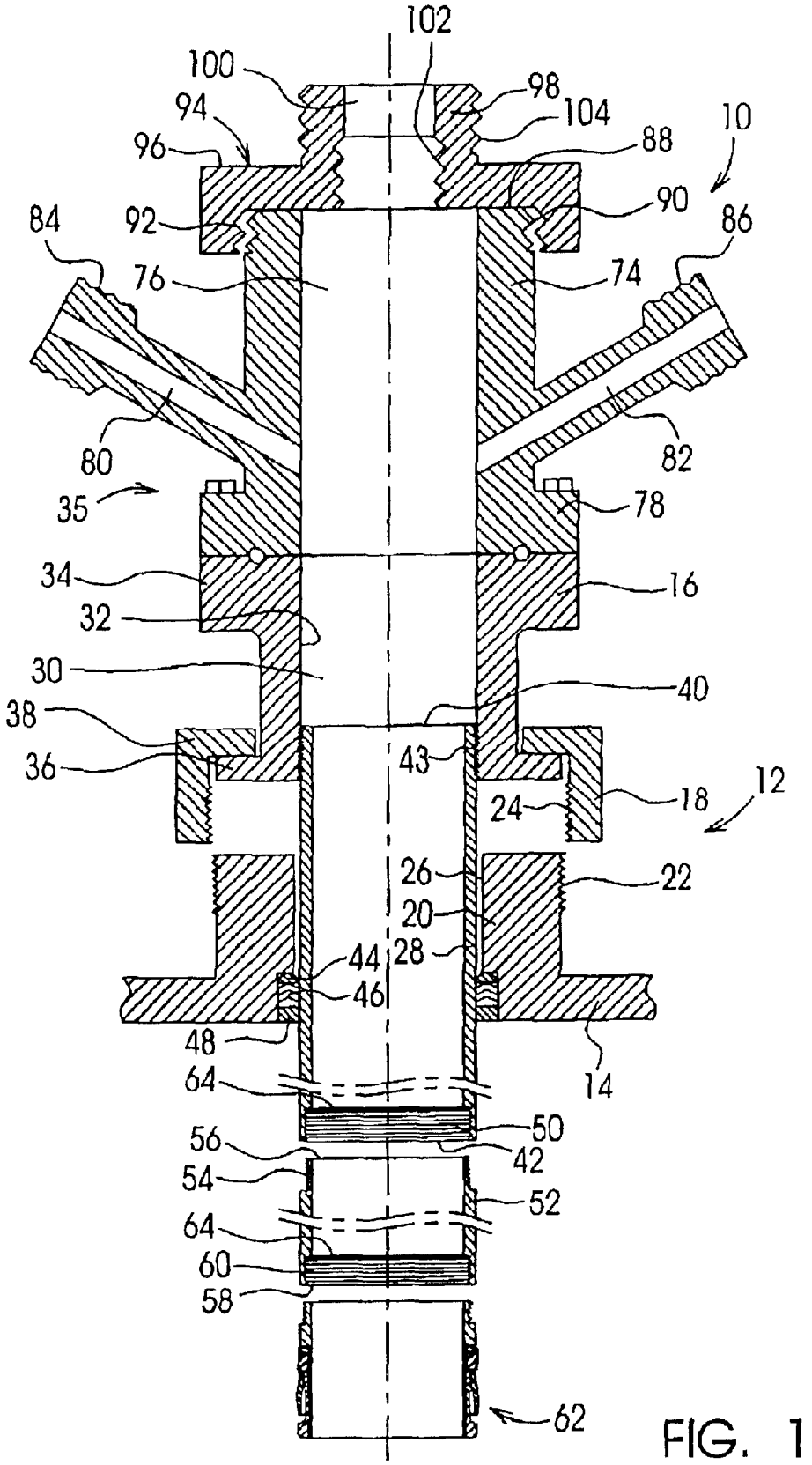
FIG. 1 is a cross-sectional view of a preferred embodiment of the BOP protector in accordance with the invention, showing the mandrel in an exploded view.

FIG. 1 shows a cross-sectional view of the apparatus for protecting the blowout preventers (hereinafter referred to as a BOP protector) in accordance with the invention, generally indicated by reference numeral 10. The apparatus includes a lockdown mechanism 12 which includes a base member 14, a mandrel head 16 and a lockdown nut 18 that detachably interconnects the base member 14 and the mandrel head 16. The base member 14 includes a flange and an integral sleeve 20 that is perpendicular to the flange of the base member 14. A spiral thread 22 is provided on an exterior of the integral sleeve 20. The spiral thread 22 is engageable by a complimentary spiral thread 24 on an interior surface of the lockdown nut 18. The flange of the base member 14 with the integral sleeve 20 form a passage 26 that permits a mandrel 28 to pass therethrough. The mandrel head 16 includes an annular flange, having a central passage 30 defined by an interior wall 32. A top flange 34 is adapted for connection to a fracturing head 35. A lower flange 36 retains a top flange 38 of the lockdown nut 18. The lockdown nut 18 secures the mandrel head 16 from upward movement with respect to the base member 14 when the lockdown nut 18 engages the spiral thread 22 on the integral sleeve 20.

The mandrel 28 has a mandrel top end 40 and a mandrel bottom end 42. Complimentary spiral threads 43 are provided on the exterior of the mandrel top end 40 and on a lower end of the interior wall 32 of the mandrel head 16 so that the mandrel top end 40 may be securely attached to the mandrel head 16. One or more O-rings (not shown) provide a fluid-tight seal between the mandrel head 34 and the mandrel 28. The passage 26 through the base member 14 has a recessed region at the lower end for receiving a steel spacer 44 and packing rings 46 preferably constructed of brass, rubber and fabric. The steel spacer 44 and packing rings 46 define a passage of the same diameter as the periphery of the mandrel 28. The packing rings 46 are removable and may be interchanged to accommodate different sizes of mandrel 28. The steel spacer 44 and packing rings 46 are retained in the passage 26 by a retainer nut 48. The combination of the steel spacer 44, packing rings 46 and the retainer nut, provide a fluid seal to prevent passage to the atmosphere of well fluids from an exterior of the mandrel 28 and the interior of the BOP when the mandrel 28 is inserted into the BOP, as will be described below with reference to FIGS. 3–5.

An internal threaded connector 50 on the mandrel bottom end 42 is adapted for the connection of mandrel extension sections of the same diameter. The extension sections permit the mandrel 28 to be lengthened, as required by different wellhead configurations. An optional mandrel extension 52, has a threaded connector 54 at a top end 56 adapted to be threadedly connected to the mandrel bottom end 42. An extension bottom end 58, includes a threaded connector 60 that is used to connect a sealing assembly 62, which will be described below with reference to FIG. 7. High pressure O-ring seals 64, well known in the art, provide a high pressure fluid seal in the threaded connectors between the mandrel 28, the optional mandrel extension(s) 52 and the sealing assembly 62.

The mandrel 28, the mandrel extension 52 and the sealing assembly 62 are preferably each made from 4140 steel, a high-strength steel that is commercially available. 4140 steel has a high tensile strength and a Burnell hardness of about 300. Consequently, the assembled mandrel 28 is adequately robust to contain extremely high fluid pressures of up to 15,000 psi, which approaches the burst pressure of the well casing.

The fracturing head 35 includes a sidewall 74 surrounding a central passage 76 that has a diameter not smaller than the internal diameter of the mandrel 28. A bottom flange 78 is provided for connection in a fluid tight seal to the mandrel head 16. Two or more radial passages 80, 82 with threaded connectors 84, 86 are provided to permit well stimulation fluids to be pumped through the wellhead.

The radial passages 80, 82 are preferably oriented at an acute upward angle with respect to the sidewall 74. At the top end 88 of the sidewall 74, a threaded connector 90 removably engages a threaded connector 92 of one embodiment of a tubing adaptor 94, in accordance with the invention. The tubing adapter 94 includes a flange 96, the threaded connector 92 and a sleeve 98. The tubing adapter 94 also includes a central passage 100 with the threads 102 for detachably connecting a tubing joint of a tubing string. A spiral thread 104 is provided on the exterior of the sleeve 98 and adapted for connecting other equipment, for example, a high pressure valve 136 (FIG. 4).

The mandrel head 16 with its upper and lower flanges 34, 36, and the lockdown nut 18 with its top flange 38 are illustrated in FIG. 1 respectively as an integral unit assembled, for example, by welding or the like. However, persons skilled in the art will understand that any one of the mandrel head 16 or the lockdown nut 18 may be constructed to permit the mandrel head 16 or the lockdown nut 18 to be independently replaced.

Figure 2:
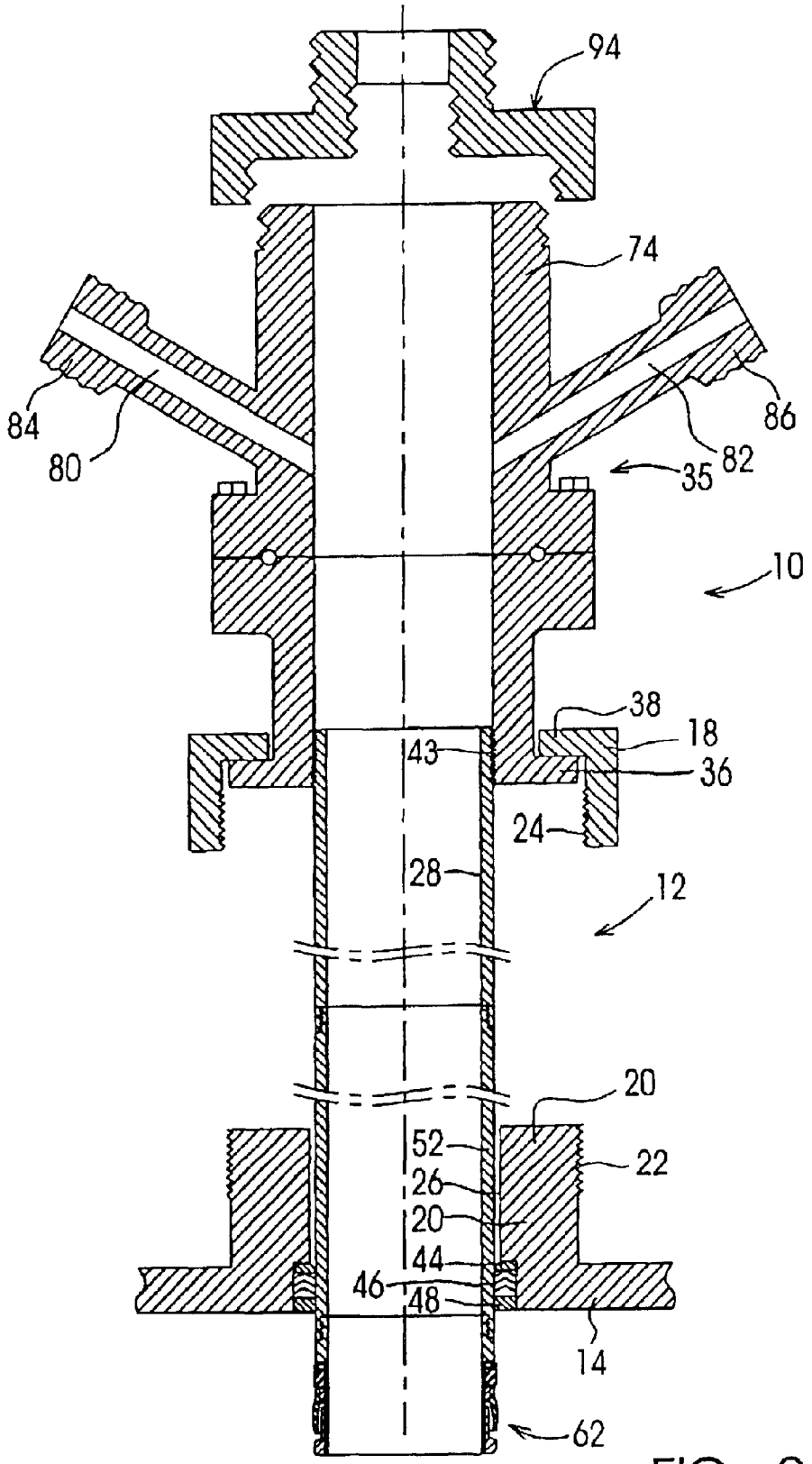
FIG. 2 is a cross-sectional view of the embodiment shown in FIG. 1 illustrating the BOP protector in a condition ready to be mounted to a wellhead.

FIG. 2 illustrates the BOP protector 10 shown in FIG. 1, prior to being mounted to a BOP for a well stimulation treatment. The mandrel head 16 is connected to the top end of the mandrel 28, which includes any required extension section(s) 52 and the pack-off assembly 62 to provide a total length of the mandrel 16 required for a particular wellhead.

Figure 3:
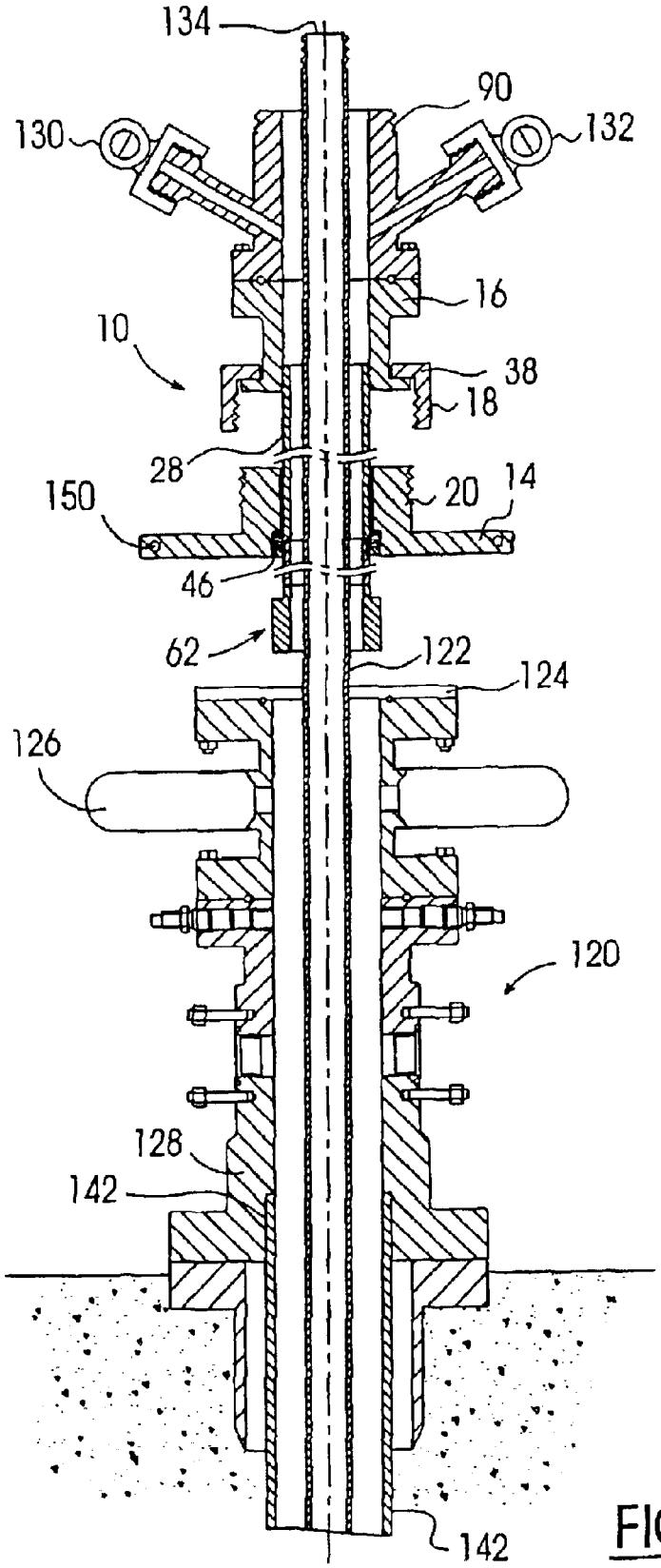
FIG. 3 is a cross-sectional view of the BOP protector shown in FIG. 2 suspended over the wellhead prior to installation on the wellhead.
Figure 4:
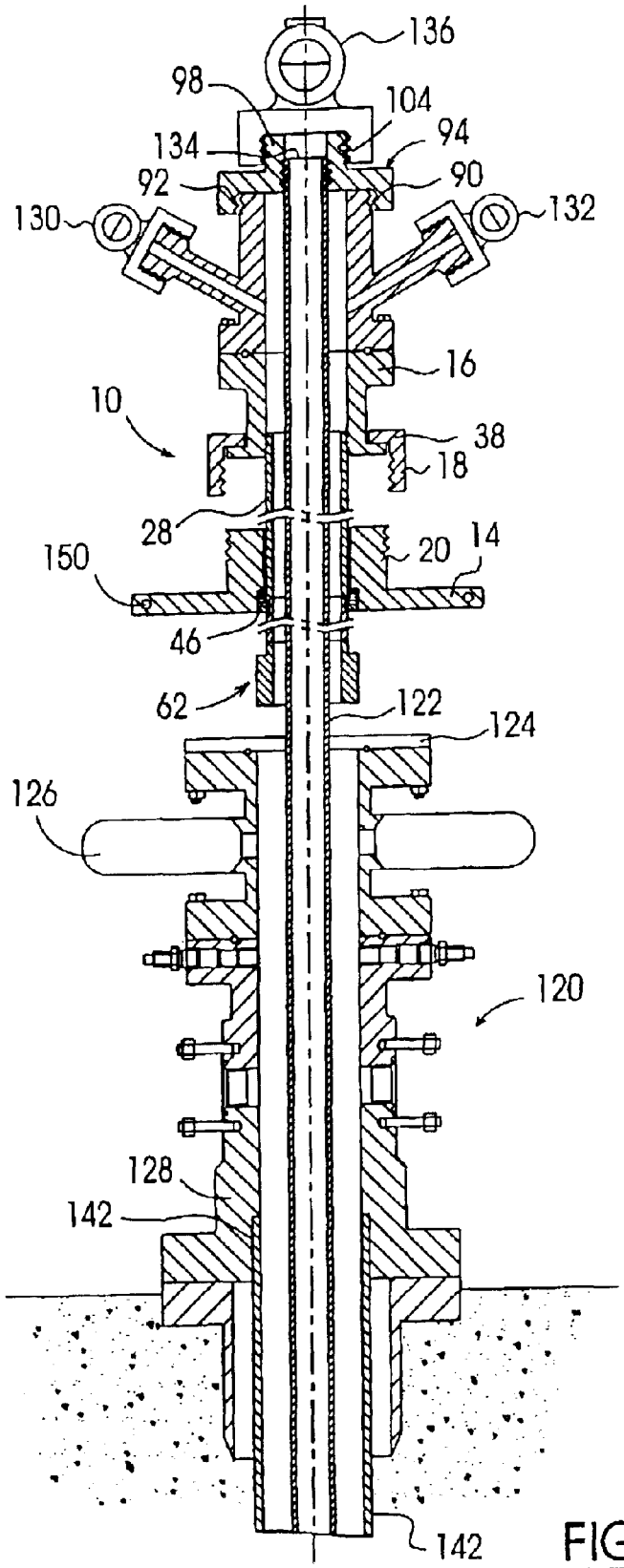
FIG. 4 is a cross-sectional view of the BOP protector shown in FIG. 3 illustrating a further step in the installation procedure, in which the tubing string is connected to a tubing adapter.
Figure 5:
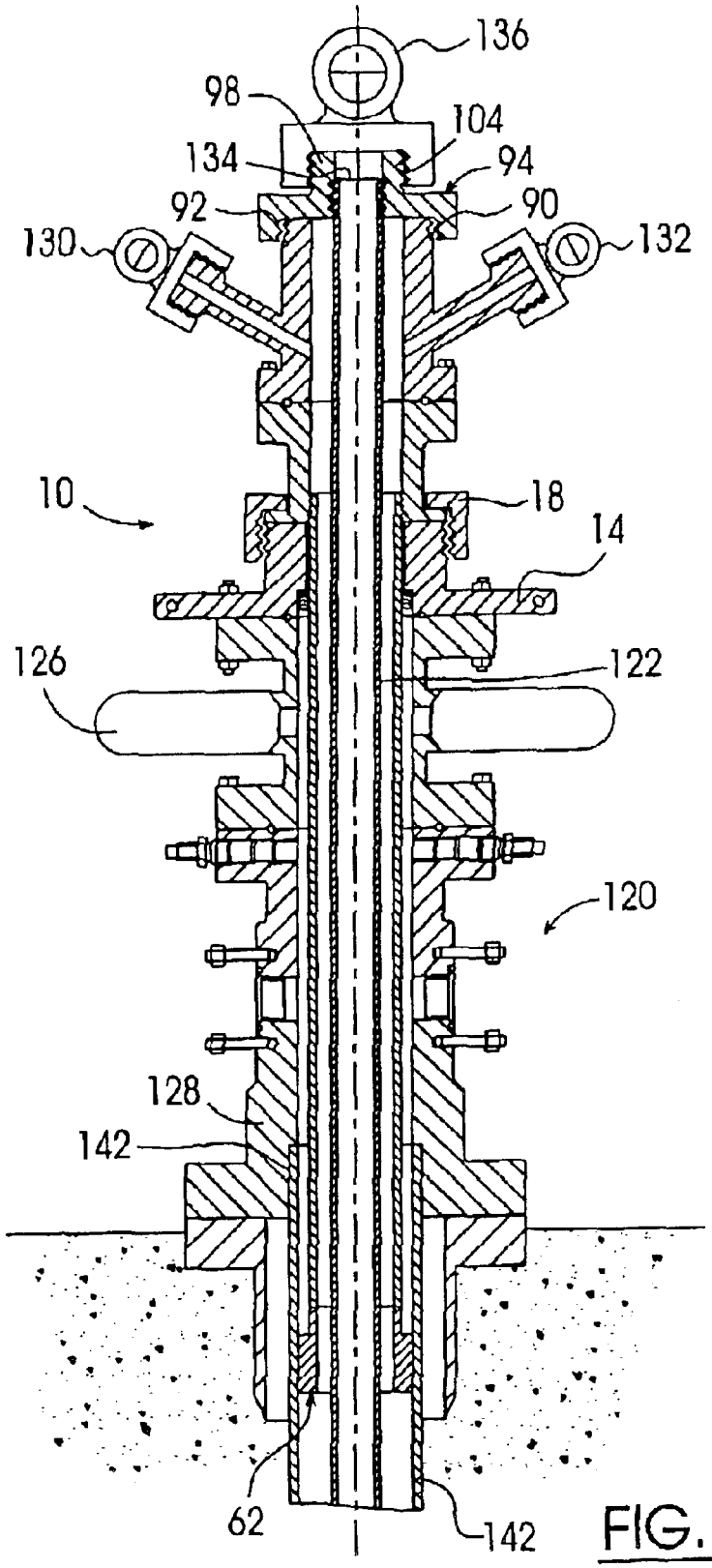
FIG. 5 is a cross-sectional view of the BOP protector shown in FIG. 4, in which the mandrel of the BOP protector is inserted through the wellhead and locked in an operative position.

FIGS. 3 through 5 illustrate the installation procedure of the BOP protector 10 to a wellhead 120 with a tubing string 122 supported, for example, by slips 124 or some other supporting device, at the top of the wellhead 120. Several components may be included in a wellhead. For purposes of illustration, the wellhead 120 is simplified and includes only a BOP 126 and a tubing head spool 128. The BOP 126 is a piece of wellhead equipment that is well known in the art and its construction and function do not form a part of this invention. The BOP 126, the tubing head spool 128 and the slips 124 are, therefore, not described. The tubing string 122 is usually supported by a tubing hanger, not shown, in the tubing head spool 128. The tubing string 122 is therefore pulled out of the well to an extent that a length of the tubing string 122 extending above the wellhead 120 is greater than a length of the BOP protector 10. The tubing string 122 is then supported at the top of the BOP 126 using slips, for example, before the installation procedure begins. Two high pressure valves 130 and 132 are mounted to the threaded connectors 84, 86, preferably before the BOP protector 10 is installed.

As illustrated in FIG. 3, the BOP protector 10 is suspended over the wellhead 122 by a crane or other lift equipment (not shown). The BOP protector 10 is aligned with the tubing string 122 and lowered over the tubing until the top end 134 of the tubing string 122 extends above the top end 88 of the sidewall 74.

FIG. 4 illustrates the next step of the installation procedure. A tubing adapter 94 is first connected to the top end 134 of the tubing string 122. The tubing adapter 94 is then connected to the top of the fracturing head. A high pressure valve 136 is mounted to the tubing adapter 94 via the thread 104 on the sleeve 98. The tubing string 122 and the BOP protector 10 are then lifted using a rig, for example, so that the slips 124 can be removed. The rig lowers the tubing string 122 and the BOP protector 10 onto the top of the BOP so that the base member 14 rests on the BOP 126. The mandrel 28 is inserted from the top into to the BOP 126 but remains above the BOP rams (not shown). Persons skilled in the art will understand that in a high pressure wellbore, the tubing string 122 is plugged and the rams of the BOP are closed around the tubing string 122 before the installation procedure begins, so that the fluids under pressure in the wellbore are not permitted to escape from the tubing string or the annulus between the tubing string and the wellhead 120.

To open the rams of the BOP 126 and further insert the mandrel 28 down through the wellhead, the high pressure valves 130, 132 and 136 must be closed and the base member 14 mounted to the top of the BOP 126. The packing rings 46 and all other seals between interfaces of the connected parts, seal the central passage of the BOP protector 10 against pressure leaks. The BOP rams are now opened after the pressure is balanced across the BOP rams. This procedure is well known in the art and is not described. After the BOP rams are opened, the rig further lowers the BOP protector 10 to move the mandrel bottom end down through the BOP. The BOP protector 10 is in an operative position where the sealing assembly 62 is inserted into the casing 142. As noted above, the extension section(s) is optional and of variable length so that the assembled mandrel 28, including the sealing assembly 62, has adequate length to ensure that the sealing assembly 62 is inserted into the casing 142. The lockdown nut 18 shown in FIG. 5, secures the mandrel 28 in the operative position against an upward fluid pressure.

The BOP protector 10, in accordance with the above-described embodiments of the invention, has extensive applications in well treatments to stimulate production. After the BOP protector 10 is installed to the wellhead as illustrated in FIG. 5, a pressure test is usually done by opening the tubing head spool side valve to ensure that the BOP and the wellhead are properly sealed. The high pressure lines (not shown) can be hooked up to high pressure valves 130, 132 and 136 to begin a wellhead stimulation treatment. A high pressure well stimulation fluids can be pumped down through any one or more of the three valves into the well. The tubing string can also be used to pump a different fluid or gas down into the well while other materials are pumped down the casing annulus so that the fluids only commingle downhole at the perforations area and are only mixed in the well.

In the event of a "screen-out", the high pressure valve 136 which controls the tubing string, may be opened and hooked to the pit (not shown). This permits the tubing string 122 to be used as a well evacuation string, so that the fluids can be pumped down the annulus of the casing and up the tubing string to clean and circulate proppants out of the wellbore. In other applications for well stimulation treatment, the tubing string 122 can be used as a dead string to measure downhole pressure during a well fracturing process.

The tubing also can be used to spot acid in the well. To prepare for a spot acid treatment, a lower limit of the area to be acidized is blocked off with a plug set in the well below a lower end of the tubing string, if required. A predetermined quantity of acid is then pumped down the tubing string to treat a portion of the wellbore above the plug. The area to be acidized may be further confined by a second plug set in the well above the first plug. Acid may then be pumped under pressure through the tubing string into the area between the two plugs.

As will be understood by those skilled in the art, coil tubing can be used for any of the stimulation treatments described above. If coil tubing is used, it is preferably run through a blast joint so that the coil tubing is protected from abrasive proppants.

Figure 6:
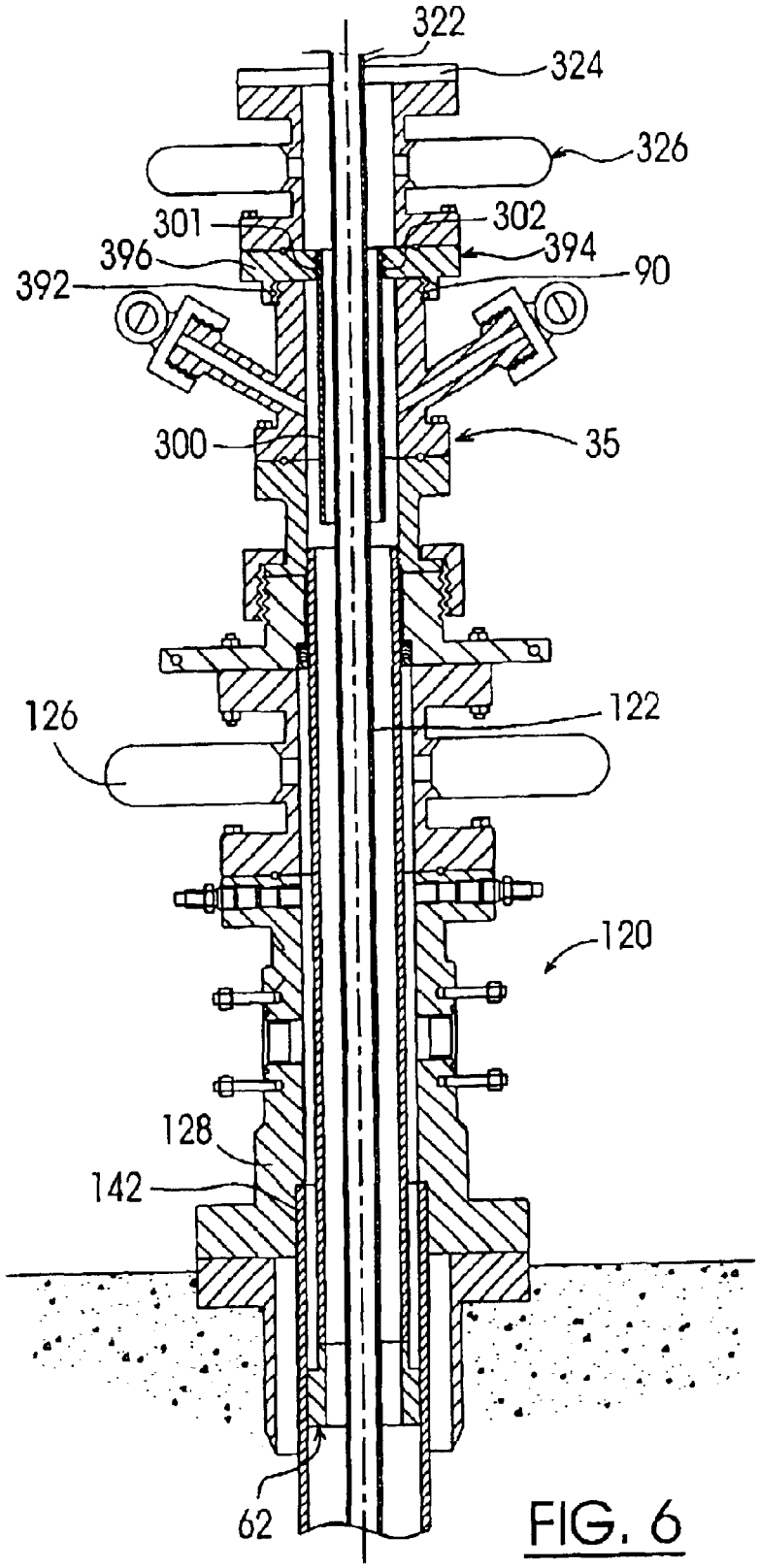
FIG. 6 is a partial cross-sectional view of a BOP protector in accordance with the invention, showing a tubing adapter flange used for mounting a BOP to permit tubing to be run into or out of the well without removing the BOP protector from the wellhead.

FIG. 6 illustrates a configuration of the BOP protector 10 in accordance with the invention that is adapted to permit tubing to be run into or out of the well. Coil tubing, which is well known in the art, is particularly well adapted for this purpose. Coil tubing is a jointless, flexible tubing available in variable lengths. If tubing is to be run into or out of the well, pressure containment is required. Accordingly, the tubing adapter 394, in this embodiment, is different from the tubing adapter 94 shown in FIGS. 1–5. The tubing adapter 394 has a flange 396 with a threaded connector 392 for engaging the thread 90 on the top of the fracturing head 35. The flange 396 is adapted to permit a second BOP 326 to be mounted to a top of the fracturing head 35. A blast joint 300, having a threaded top end 301 engages a thread 302 so that the blast joint 300 is suspended from the tubing adapter 394. The blast joint has a inner diameter large enough to permit the coil tubing 322 to be run up and down therethrough. The blast joint 300 protects the coil tubing 322 from erosion when abrasive fluids are pumped through the radial passages 80, 82 in the fracturing head 35. The coil tubing 322 is supported, for example, by slips 324 or other supporting mechanisms to the top of the BOP 326. As is understood by those skilled in the art, a "stripper" for removing hydrocarbons from coil tubing pulled out of the well may also be associated with the second BOP 326.

If tubing is to be run in and out of the well during a stimulation treatment, a third BOP, not shown, may be required, as is also well known in the art. As is well understood, the BOPs are operated in sequence whenever the tubing is pulled from or inserted into the well.

The method of installing the BOP protector 10 shown in FIG. 6, to permit tubing to be run into or out of a well while protecting the BOP 126 on the wellhead during a well stimulation treatment is described below. The base member 14 is first mounted to the top of the BOP 126 while the bottom end of the mandrel is inserted from the top into the BOP 126. The BOP 326 is closed and the BOP 126 is opened after the pressure across the BOP 126 is equalized. The fracturing head 35 and attached BOP 326 are lowered to stroke the mandrel bottom end down through the BOP 126. The lockdown nut 18 is screwed down when the mandrel 28 is in the operative position and the sealing mechanism 62 is sealed inside the casing 142.

The apparatus in accordance with the invention does not significantly restrict fluid flow along the annulus of the casing or include components susceptible to wash-out. More advantageously, the apparatus in accordance with the invention enables an operator to move the tubing string up and down or run tubing into and out of a well without removing the apparatus from the wellhead. A tubing string can also be moved up or down in the well while stimulation fluids are being pumped into the well, as will be understood by those skilled in the art. The apparatus is especially well adapted for use with coil tubing which provides a safer operation in which there are no joints, no leaking connections and no snubbing unit needed if it is run in under pressure. Running coil tubing is also a faster operation that can be used easier and less expensively in remote areas, such as off-shore.

Figure 7:
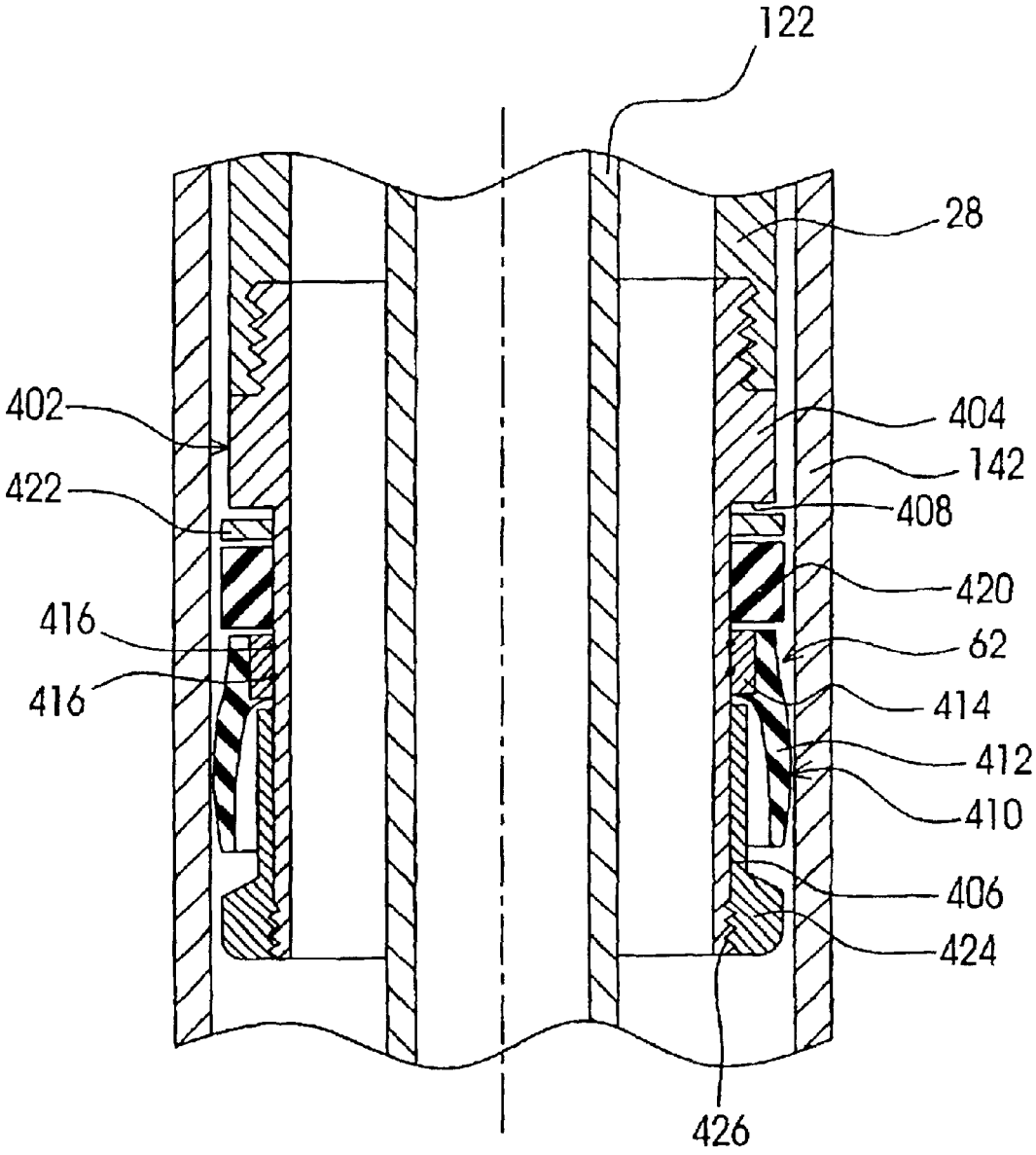
FIG. 7 is a cross-sectional view of a preferred embodiment of a sealing assembly for the BOP protector shown in FIGS. 1–6.

FIG. 7 schematically illustrates a sealing assembly 62 in accordance with a preferred embodiment of the invention inserted into the casing 142 of a hydrocarbon well. The sealing assembly 62 includes a cup tool 402 which threadedly connects to the bottom end of the mandrel 28 or a mandrel extension 52 (FIG. 1). The cup tool 402 has a top end 404 with a diameter equal to a diameter of the mandrel 28 and a bottom end 406 of a smaller outer diameter. Located between the top end 404 and the bottom end 406 is a radial shoulder 408. A cup 410 includes a resilient depending skirt 412, which is typically formed with a rubber compound well known in the art. The skirt 412 is bonded to a steel ring 414 that is axially slidable over the bottom end 406 of the cup tool 402. A pair of O-rings 416 provide a fluid seal between the steel ring 414 and the bottom end 406 of the cup tool 402. Located above the cup 410 is a resilient compressible sealing element 420 and a gauge ring 422. The cup 410, sealing element 420 and gauge ring 422 are retained on the bottom end 406 of the cup tool 402 by a bullnose 424 which threadedly engages threads 426 on the bottom end 406 of the cup tool 402. The bullnose 426 guides the sealing assembly through the wellhead and helps protect the resilient skirt 412 of the cup 410 from damage when the tool is inserted through the wellhead into the casing.

When the sealing assembly 62 is inserted into the casing 142 of a wellbore and exposed to fluid pressures in the wellbore, the resilient skirt 412 of the cup 410 is forced outwardly against the casing 142 and the cup is forced upwardly against the resilient sealing element 420. The resilient sealing element is compressed against the gauge ring 422 and deforms radially against the cup tool 402 and the casing 142 to provide a high pressure fluid seal in the annulus between the sealing assembly 62 and the casing 142.

Modifications and improvements to the above-described embodiments of the invention, may become apparent to those skilled in the art. For example, although the mandrel head and the fracturing head are shown and described as separate units, they may be constructed as an integral unit. Many other modifications may also be made.

The foregoing description is intended to exemplary rather than limiting. The scope of the invention is therefore intended to be limited solely by the scope of the appended claims.

I claim:

1. An apparatus for protecting a blowout preventer mounted to a wellhead from exposure to fluid pressures, abrasives and corrosive fluids used in a well treatment to stimulate production, and for supporting a tubing string in a wellbore so that the tubing string is accessible during the well treatment, the apparatus including a mandrel adapted to be inserted down through the blowout preventer to an operative position, comprising:

a base member adapted for connection to the wellhead, the base member including fluid seals through which the mandrel is reciprocally movable;

a fracturing head including a central passage in fluid communication with the mandrel and at least one radial passage in fluid communication with the central passage;

a tubing adapter mounted to a top end of the fracturing head, the tubing adapter supporting the tubing string while permitting fluid communication with the tubing string;

a sealing assembly attached to a bottom end of the mandrel to seal an annulus between the mandrel and a casing of the well when the mandrel is in the operative position; and a lock mechanism for locking the apparatus in the operative position to inhibit upward movement of the mandrel induced by fluid pressures in the wellbore.

2. An apparatus as claimed in claim 1 wherein the tubing adapter comprises a first threaded connector to permit connection of the tubing string so that the tubing string is suspended from the tubing adapter, and a second connector to permit connection of a high pressure valve to permit fluids to be pumped through the tubing string.

3. An apparatus as claimed in claim 1 wherein the tubing adapter comprises a flange through which coil tubing can be run into the well and a blowout preventer is mounted to the tubing adapter to seal around the coil tubing and contain fluid pressure within the wellbore.

4. An apparatus as claimed in claim 1 wherein the lock mechanism comprises a mechanical lockdown mechanism including a spiral thread on the base member engaged by a complementary thread of a lockdown nut.

5. An apparatus as claimed in claim 1 wherein the sealing assembly comprises an annular cup, the annular cup being adapted to provide a high pressure fluid seal in the annulus when fluids used in a well treatment to stimulate production are pumped into the well.

6. An apparatus as claimed in claim 5 wherein the sealing assembly further includes a cup tool connected to a bottom end of the mandrel, the cup tool including a radial retainer shoulder adjacent a bottom end of the mandrel to retain the annular cup.

7. An apparatus as claimed in claim 6 wherein the annular cup comprises a steel ring bonded to an elastic cup so that an axial force is exerted against the elastic cup when the fluids are pumped into the well.

8. An apparatus as claimed in claim 7 wherein the annular cup further comprises an O-ring mounted in a groove in an inner surface of the steel ring to seal an annulus between the cup tool and the steel ring to which the elastic cup is bonded.

9. An apparatus as claimed in claim 1 wherein the apparatus further comprises a blast joint through which the tubing string is run to protect the tubing string from erosion when abrasive fluids are pumped through the at least one radial passage in the fracturing head.

10. An apparatus as claimed in claim 9 wherein the blast joint has a threaded top end that engages a complimentary thread on the tubing adapter.

11. A method of providing access to a tubing string while protecting at least one blowout preventer on a wellhead from exposure to fluid pressure, abrasive and corrosive fluids during a well treatment to stimulate production, comprising the steps of sequentially:

a) suspending an apparatus above the wellhead, the apparatus comprising a mandrel having a mandrel top end and a mandrel bottom end that includes an annular sealing assembly, a fracturing head mounted to the mandrel top end, the fracturing head having an axial passage in fluid communication with the mandrel and at least one radial passage in fluid communication with the axial passage, and a base member for detachably securing the mandrel to the wellhead;

b) aligning the apparatus with a tubing string supported on the wellhead and extending above the wellhead, and lowering the apparatus until a top end of the tubing string extends through the axial passage above the fracturing head;

c) connecting a tubing adapter to the top end of the tubing string, connecting the tubing adapter to a top end of the fracturing head, lowering the tubing string and the apparatus until the apparatus rests on the wellhead, and mounting the base member to the wellhead;

d) opening the at least one blowout preventer, as required;

e) stroking the mandrel through the wellhead into the casing of the well until the mandrel reaches an operative position in which the seal assembly is in sealing contact with an inner wall of the casing; and f) locking the fracturing head to inhibit the mandrel from upward movement induced by fluid pressure in the well.

12. A method as claimed in claim 11 wherein prior to performing step (a), the method further comprises a step of:

pulling the tubing string and supporting tubing hanger from the wellhead and removing the tubing hanger, and further raising the tubing string until the tubing string is pulled out of the well to an extent that a length of the tubing string above the wellhead exceeds a length of the apparatus for protecting the blowout preventer, and supporting the tubing string at the wellhead.

13. A method as claimed in claim 12, further comprising a step of:

mounting at least one high-pressure valve to the tubing adapter in operative fluid communication with the tubing string.

14. A method as claimed in claim 11 wherein after step (c) and prior to step (d) the method further comprises a step of equalizing fluid pressure across the at least one blowout preventer.

15. A method as claimed in claim 11 further comprising a step of utilizing the tubing string as a dead string to measure downhole pressure during the well stimulation treatment.

16. A method as claimed in claim 11 further comprising a step of utilizing the tubing string to pump well stimulation fluids into the well during the well stimulation treatment.

17. A method as claimed in claim 16 further comprising a step of utilizing the tubing string in combination with the at least one radial passage in the fracturing head to pump well stimulation fluids down into the well.

18. A method as claimed in claim 11 further comprising a step of utilizing the tubing string as a well evacuation string in the event of a screen-out, so that fluids can be pumped down the annulus of the casing and up the tubing string to clean and circulate proppants out of the wellbore.

19. A method as claimed in claim 11 further comprising a step of pumping a first fluid down the tubing string and pumping a different, second fluid down the annulus of the well, so that the first and second fluids co-mingle in the well.

20. A method as claimed in claim 11 wherein the tubing string is used for spotting acid in the well, and the method further comprises steps of:

setting a first plug in the well below a lower end of the tubing string, if required, to define a lower limit of an area to be acidized; and pumping acid down the tubing string to treat a portion of the wellbore above the first plug.

21. A method as claimed in claim 20 further comprising steps of setting a second plug in an area above the first plug to define an upper limit of the area to be acidized, and pumping acid under pressure through the tubing string into the area to be acidized.

22. A method of running a tubing string into or out of a well while protecting at least one blowout preventer on a wellhead during a well treatment to stimulate production, comprising steps of:

a) mounting to the wellhead a base member of an apparatus for protecting the at least one blowout preventer during the well treatment, the apparatus comprising a mandrel having a mandrel top end and a mandrel bottom end that includes an annular sealing assembly, a fracturing head mounted to the mandrel top end, the fracturing head having an axial passage in fluid communication with the mandrel and at least one radial passage in fluid communication with the axial passage;

b) closing a blowout preventer mounted to an adapter flange mounted to a top the fracturing head;

c) opening the at least one blowout preventer on the wellhead, as required;

d) stroking the mandrel bottom end down through the at least one blowout preventer and the wellhead into the casing until the mandrel is in an operative position in which the fracturing head rests against the base member and the annular sealing assembly is in fluid sealing engagement with an inner wall of the casing of the well;

e) locking the mandrel in the operative position; and f) running the tubing string into or out of the well through the blowout preventer mounted to the adapter flange.

23. The method as claimed in claim 22 wherein the step of running the tubing string comprises a step of running a coil tubing string into or out of the well.

* * * * *